US006334495B2

(12) United States Patent
Deimel et al.

(10) Patent No.: US 6,334,495 B2
(45) Date of Patent: Jan. 1, 2002

(54) FLUID OPERATED PERCUSSION DEVICE

(75) Inventors: Thomas Deimel, Mülheim; Marcus Geimer, Dettighofen; Marcus Mellwig, Hagen; Heinz-Jürgen Prokop, Ratingen, all of (DE)

(73) Assignee: Krupp Berco Bautechnik GmbH, Essen (DE)

( * ) Notice: Subject to any disclaimer, the term of this patent is extended or adjusted under 35 U.S.C. 154(b) by 0 days.

(21) Appl. No.: 09/808,940

(22) Filed: Mar. 16, 2001

(30) Foreign Application Priority Data

Mar. 17, 2000 (DE) ..... 100 13 270

(51) Int. Cl.[7] ..... B25D 9/14

(52) U.S. Cl. ..... 173/207; 173/17; 173/206; 173/115; 173/89

(58) Field of Search ..... 173/89, 206, 207, 173/208, 152, 156, 135, 115

(56) References Cited

U.S. PATENT DOCUMENTS

| | | | | |
|---|---|---|---|---|
| 2,619,072 A | * | 11/1952 | Clarke, Jr. et al. | 173/115 |
| 5,064,005 A | * | 11/1991 | Krone | 173/208 |
| 5,477,932 A | * | 12/1995 | Asakura et al. | 173/206 |
| 5,529,132 A | * | 6/1996 | Evarts et al. | 173/152 |
| 5,607,022 A | * | 3/1997 | Walker et al. | 173/89 |
| 5,860,481 A | * | 1/1999 | Prokop et al. | 173/17 |
| 5,884,713 A | * | 3/1999 | Shinohara et al. | 173/206 |
| 6,102,133 A | * | 8/2000 | Scheid et al. | 173/208 |

FOREIGN PATENT DOCUMENTS

| | | |
|---|---|---|
| DE | PS 5 51 396 | 3/1932 |
| DE | 195 36 659 A1 | 3/1998 |
| DE | 0 934 804 A2 | 8/1999 |
| EP | 0 919 339 A1 | 6/1999 |
| JP | 10-80878 | 3/1998 |

* cited by examiner

*Primary Examiner*—Scott A. Smith
(74) *Attorney, Agent, or Firm*—Venable; Norman N. Kunitz

(57) ABSTRACT

A fluid-operated percussion device (1) having a percussive piston (3), which alternately executes a work stroke and a return stroke due to the effect of a control. To avoid no-load strikes, in one embodiment of the percussion device (1), the percussive piston (3) is shut down if it has overshot the extended position occurring in normal operation (long- and/or short-stroke operation) by a predetermined distance in the work-stroke direction (arrow 3*e*) and reached a no-load-strike position. For this purpose, the interior (2*d*) of the work cylinder (2) that receives the percussive piston (3) additionally has a no load-strike opening (20*a*), which is connected to the pressure line (8) of the percussion device (1) with an interposed safety element (21) that can be switched between an inoperative position and an operative position.

8 Claims, 8 Drawing Sheets

FLUID OPERATED PERCUSSION DEVICE

CROSS REFERENCE TO RELATED APPLICATION

This application claims the priority of German patent Application No. 100 13 270.7 filed Mar. 17, 2000, which is incorporated herein by reference.

BACKGROUND OF THE INVENTION

The invention relates to a fluid-operated percussion device having a percussive piston, which moves in a work cylinder and strikes a tool, and a control having a slide valve, which moves in a pilot valve. The percussive piston has two piston surfaces of different sizes, with the smaller piston surface, which is effective in the direction of the return stroke, being continuously connected to a pressure line that is acted upon by the work pressure, and the larger piston surface, which is effective in the direction of the work stroke, being alternately connected via the pilot valve to the pressure line and a pressureless return line. The slide valve has two valve surfaces that are of different sizes and are effective in opposite directions of movement, with the smaller valve surface, which acts on the slide valve in the direction of the return-stroke position of the slide valve, being continuously connected to the pressure line, and with the larger valve surface being alternately connected temporarily to the pressure line and to the return line via a circumferential groove disposed between the piston end surfaces.

The German Published Patent Application DE 196 36 659 A1 describes a percussion device of the generic type mentioned above.

The known percussion device is embodied such that the pilot valve is switched into the return-stroke position when a percussive-piston limit position is exceeded in the direction of the work stroke. During the return stroke, which follows immediately thereafter, a short-stroke line is acted upon by pressure, which prematurely displaces the pilot valve into the work-stroke position, so the percussive piston only executes a short stroke. In the event that the tool cooperating with the percussive piston penetrates the material to be comminuted, and the percussive piston leaves its normal striking plane, the automatic change in stroke reduces the energy for individual strikes.

Depending on the working and application conditions, it may be desirable to equip fluid-operated percussion devices with a no-load-strike safeguard, especially from the standpoint of avoiding an undesired stress or the ensuing damage. The Japanese Published, Non-Examined Patent Application Hei10-80878 of Mar. 31, 1998, proposes such a solution within the scope of a hydraulic striking device.

In the described hydraulic striking device, a short-stroke input disposed on the work cylinder of the percussive piston is connected via a stroke-reversing valve to a valve-control circuit and to a high-pressure circuit, which allows the function of the striking device to be influenced as a function of the position of the stroke-reversing valve, for avoiding no-load strikes.

The stroke-reversing valve associated with the short-stroke input can assume either a no-load-prevention position or a normal-operation position. In the first position, the work pressure present in the high-pressure circuit is applied to the short-stroke input. In contrast to this, in the normal-operation position, the connection between the short-stroke input and the high-pressure circuit is broken, which may cause the known striking device to function in short-stroke operation.

Based on the association of the stroke-reversing valve with the short-stroke input, it is impossible to also prevent the execution of no-load strikes, regardless of the effect of the short-stroke input.

SUMMARY OF THE INVENTION

It is therefore the object of the invention to modify the generic percussion device such that the percussive piston is shut down, regardless of other control-related circumstance if it has reached a predetermined extended position in the direction of the work stroke.

The above object generally is achieved according to the present invention by a fluid-operated percussion device comprising:

a percussive piston that moves in a work cylinder and strikes a tool, with the percussive piston having two opposed piston end surfaces of different sizes, with the smaller piston surface, which is effective in the direction of a return stroke, being continuously connected to a pressure line that is acted upon by a work pressure, and with the larger piston end surface, which is effective in the direction of a work stroke, being alternately connected via a pilot valve to the pressure line and to a pressureless return line;

a control having a slide valve that moves in a pilot valve, said slide valve having two valve surfaces that are of different sizes and are effective in opposite directions of movement, with the smaller valve surface of the slide valve, which smaller valve surface acts on the slide valve in the direction of the return-stroke position of the slide valve, being continuously connected to the pressure line, and with the larger valve surface of the slide valve being alternately connected temporarily to the pressure line and to the return line via a circumferential groove disposed on the surface of the piston between the piston end surfaces;

the interior of the work cylinder additionally has a no-load-strike opening, which is enabled, in the direction of the interior, by a front piston collar of the percussive piston, which front piston collar has the smaller piston surface, after the percussive piston has overshot an extended position occurring in normal operation by a predetermined distance in the work-stroke direction to assume a no-load-strike position;

a safety element, which can be switched between a first inoperative end position and a second operative end position and whose input side is connected to the pressure line, is disposed upstream of the no-load-strike opening, with the safety element acting on the no-load-strike opening with the work pressure originating from the safety element in the second operative end position, and with the safety element breaking the connection between the pressure line and the no-load-strike opening in the first inoperative end position; and when the safety element assumes the second operative end position and the percussive piston reaches the no-load-strike position, the work pressure applied to the no-load-strike opening acts on the control via the circumferential groove such that the slide valve of the control is blocked in the work-stroke position.

As can be seen from the above, the invention proposes to additionally provide the interior of the work cylinder that receives the percussive piston with a no-load-stroke opening, which opening is only enabled in the direction of the interior by the front piston collar of the percussive piston, which collar has the smaller piston end surface, after the percussive piston has overshot the extended position occurring in normal operation by a predetermined distance in the direction of the work stroke to assume a no-load striking position.

Additionally, a safety element that can be switched between two end positions, i.e., an operative position and an operative position, and whose input side is connected to the pressure line having the work pressure is disposed upstream of the no-load-strike opening, with the no-load-strike opening being acted upon by the work pressure originating from the safety element in the operative position, and with the safety element breaking the connection between the pressure line and the no-load-strike opening in the inoperative position.

Depending on the predetermined structural conditions, within the spirit of the invention, the additional no-load-strike opening can be displaced further in the direction of the tool. In other words, it is located closer to the tool than the opening of a likewise provided short-stroke line, when seen in the axial direction of the percussive piston.

If the safety element assumes the operative position, and the percussive piston has reached the no-load-strike position, the work pressure applied to the no-load-strike opening acts on the control via the circumferential groove disposed between the two piston collars of the percussive piston such that the slide valve of the control is blocked in the work-stroke position. The work pressure applied to the no-load-strike opening prevents the control from switching from the work-stroke position into the return-stroke position, so the percussive piston cannot move in the direction of its return stroke. Consequently, the percussion device is shut down, and can only be restarted through the mechanical lifting of the percussive piston, i.e., the pressing of the percussive piston against the tool.

Of great significance for the invention is the fact that an effective no-load-strike opening in terms of control is additionally present, which—regardless of the conditions in long- and/or short-stroke operation—allows the percussive piston to be shut down after it has attained a deviating no-load-strike position. Unlike in the state of the technology cited at the outset, the switchable safety element cooperating with the no-load-strike opening is not connected to the opening of a short-stroke line that may be present.

Correspondingly, the percussion device embodied according to the invention can also be safeguarded against no-load strikes if it is possible to switch between long- and short-stroke operation.

As already mentioned, the position of the no-load-strike opening can be defined by the fact that it is located closer to the tool (seen in the axial direction of the percussive piston) than the preceding opening into the interior of the work cylinder, by way of which the control is influenced by the switch between the work-stroke position and the return-stroke position.

The subject of the invention can be modified in that the breakable connection between the safety element and the no-load-strike opening is located inside a housing that represents at least one component of the work cylinder.

The breakable connection can either be disposed inside its own housing, which is in turn connected to the work cylinder, or be located directly inside the work cylinder itself.

Provided that the safety element meets the other aforementioned requirements, it can have an arbitrary embodiment and location. The safety element preferably constitutes a detachable component, which is essentially disposed inside the housing or the work cylinder, and is accessible from the outside of the percussion device. In this way, the safety element is additionally protected against external influences, particularly damage.

A simple embodiment variation of the invention is for the safety element to be embodied as a rotary slide valve. This valve need only be embodied and disposed such that its predetermined end position (inoperative position and operative position, respectively) is not changed by external influences.

In particular, the rotary slide valve can include a screw-in hollow cylinder and an adjusting pin with a connecting conduit, the pin being rotatably held inside the hollow cylinder. Depending on the rotational position of the adjusting pin, a connection can be produced between the no-load-strike opening and the pressure line, with the adjusting pin being clamped to the hollow cylinder in order to fix its rotational position.

Within the spirit of the invention, the safety element can also have a latching pin, which can be secured in numerous positions inside the component that receives it (housing, work cylinder). A connection is either present between the pressure line and the no-load-strike opening in a first latched position, or is broken in a second latched position. Furthermore, the safety element can be embodied such that the latching pin can be displaced longitudinally between the latched positions, counter to the effect of at least one split washer serving as a counterbearing.

In a further advantageous embodiment of the subject of the invention, the safety element has a threaded pin that is accessible from the outside of the component that receives it (housing, work cylinder) and is screwed to the component, as well as an exchangeable pin that can be fixed inside a receiving bore by the threaded pin. The exchangeable pin is either embodied as a bridge element, which connects the no-load-strike opening to the pressure line, or represents a blocking element that blocks the connection between the pressure line and the no-load-strike opening. Depending on the operating conditions of the percussion device, it is thus possible to switch the no-load safety element to be operative or inoperative simply by exchanging the exchangeable pin. The advantage of this embodiment is that the operating mode of the percussion device that is predetermined by the insertion of the exchangeable pin cannot be subjected to any undesired changes.

The invention is described in detail below in conjunction with schematic drawings of exemplary embodiments.

DETAILED DESCRIPTION OF THE PREFERRED EMBODIMENTS

Figure 1:
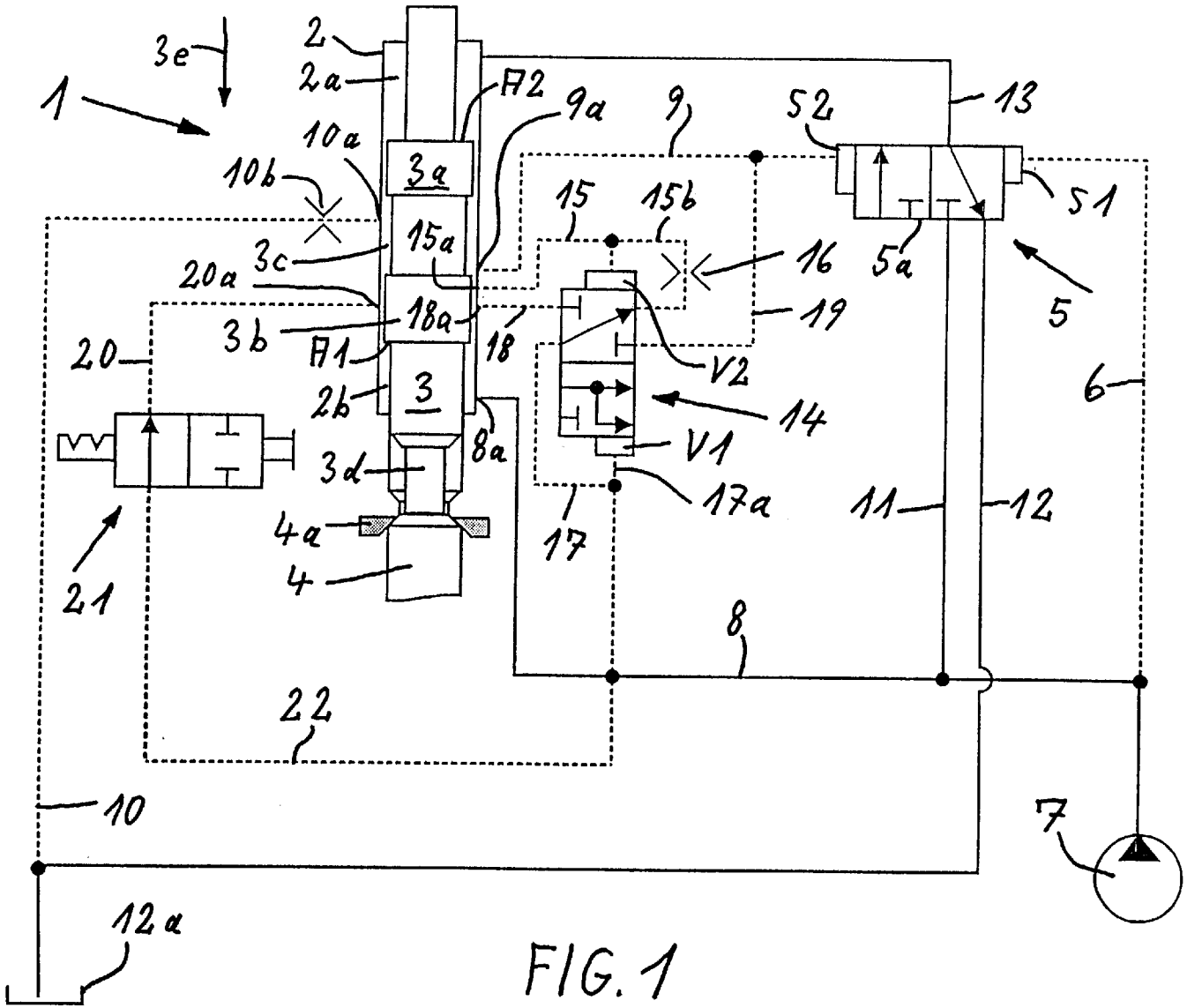
FIG. 1 is a schematic flow diagram of a percussion device embodied in accordance with the invention, with an automatic stroke reversal.

In FIG. 1, the percussion device or jackhammer indicated in its entirety by 1 and having an automatic stroke reversal has, in addition to the hydraulic lines, driving and control elements to be described below, a work cylinder 2, in which a percussive piston 3 is held to move back and forth longitudinally. Inside the work cylinder 2, this piston 3 has two piston collars 3*a* and 3*b*, which are separated from one another by a circumferential groove 3*c*.

With the work cylinder 2, the outward-oriented piston surfaces A1 and A2 of the piston collars 3*b* and 3*a*, respectively, limit a rear and a front cylindrical-space portion 2*a* and 2*b*, respectively, with the piston surface A1 being dimensioned smaller than the piston surface A2.

Outside of the work cylinder 2, the percussive piston 3 changes over into a piston tip 3*d*, which is located opposite a tool in the form of a chisel 4. The chisel movement clearance in the direction of the percussive piston 3 is limited by a stop or collar 4*a*.

An arrow 3*e* indicates the movement of the percussive piston 3 in the direction of the work stroke.

The discussed illustration depicts the percussion device during the impact of the percussive piston 3 against the chisel 4. Normal operation is presupposed here, i.e., the chisel 4 does not penetrate the material to be comminuted, and the percussive piston correspondingly assumes the predetermined, normal striking position.

The control for reversing the movement of the percussive piston 3 comprises a slide valve 5*a*, which can move in a pilot valve 5, with the smaller valve surface S1 of the slide valve 5*a* being continuously acted upon by the work pressure (system pressure), which is generated by an energy source in the form of a hydraulic pump 7, via a return line 6.

The smaller piston surface A1 is also continuously acted upon by the work pressure via a pressure line 8, which is connected to the return line 6. With respect to the work cylinder 2, the opening 8*a* of the pressure line is disposed such that it is always outside of the piston collar 3*b*, without exception, and therefore lies inside the front cylindrical-space portion 2*b*.

The larger valve surface S2 of the slide valve 5*a* is connected to the interior of the work cylinder 2 by a reversing line 9 such that the line opening 9*a* is connected to a pressureless return line 10 via the circumferential groove 3*c* in the illustrated state. The opening 9*a* and the opening 10*a* of the return line are thus spaced from each other by a distance that—when seen in the longitudinal direction of the percussive piston 3—is smaller than the axial length of the circumferential groove 3*c*.

The pilot valve 5 is connected to the pressure line 8 via a control line 11, and with the tank 12*a* and the return line 10 via a discharge line 12. The pilot valve 5 is also connected via an alternating-pressure line 13 to the rear cylindrical-space portion 2*a*, by way of which the larger piston surface A2 can be acted upon by the work pressure as needed.

The pilot valve 5 can assume two valve positions, namely the illustrated (right) return-stroke position, in which the pressure on the larger piston surface A2 is relieved via the alternating-pressure line 13 and the discharge line 12, and the (left) work-stroke position, in which the rear cylindrical-space segment 2*a* is acted upon by the work pressure via the pressure line 8, the control line 11 connected to the pressure line and the alternating-pressure line 13. Consequently, the percussive piston 3 executes a work stroke in the direction of the arrow 3*e*, counter to the restoring force originating from the smaller piston surface A1.

The percussion device 1 is further provided with a pilot control in the form of a pilot-control valve 14, which can assume either the illustrated (upper) blocking position or a (lower) opening position.

Two surfaces, namely the smaller adjusting surface V1 and the larger adjusting surface V2, influence the position of the pilot-control valve 14. The larger surface V2 is connected to the interior of the work cylinder 2 via a pilot-control line 15. The opening 15*a* of this line 15 is disposed behind the opening 9*a* of the reversing line 9 when seen in the direction of the work stroke (arrow 3*e*). On the output side, the pilot-control line 15 is connected in turn to the pilot-control valve 14 via a pilot-control branch line 15*b* provided with a screen 16.

The smaller adjusting surface V1 is connected via a pilot-control return line 17*a* to the pressure line 8, and is continuously acted upon by the work pressure via this line 8; the pilot-control valve 14 accordingly has the task of assuming the opening position (not shown) under the effect of the restoring force that acts on the adjusting surface V1.

On the input side, the pilot-control valve 14 is connected to the interior of the work cylinder 2 via a short-stroke line 18 with an opening 18*a*, and to the pressure line 8 via a pilot-control pressure line 17. The opening 18*a* of the short-stroke line 18 is disposed behind the opening 15*a* of the pilot-control line 15, again when seen in the direction of the work stroke (arrow 3*e*).

On the output side, the pilot-control valve 14 is connected to the pilot-control line 15 via the pilot-control branch line 15*b*, and to the reversing line 9 for the pilot valve 5 via an additional line 19.

As can be seen in the schematic illustration, the pilot-control pressure line 17 is connected via the pilot-control branch line 15*b* to the pilot-control line 15 in the (upper) blocking position of the pilot-control valve 14, thereby generating an adjusting force namely via the larger adjusting surface V2 that is effective in the direction of the blocking position. Moreover, in the illustrated blocking position, the short-stroke line 18 and the additional line 19 are also blocked in the direction of the pilot-control valve 14.

In the (lower) opening position of the pilot-control valve 14, the short-stroke line 18 is simultaneously connected to the pilot-control branch line 15*b* and the additional line 19, while the pilot-control pressure line 17 is blocked. Depending on the position of the percussive piston 3 relative to the opening 18*a*, either the pressure conditions in the lines 15, 15*b*, 19 and 18, or only the pressure conditions in the lines 15, 15*b* and 19, can be adapted to one another. In the latter case, the piston collar 3*b* blocks the opening 18*a* of the short-stroke line from the interior of the work cylinder 2, as shown.

In long-stroke operation, the percussion device operates as follows:

After the pilot valve 5 has been switched into the (left) work-stroke position, and the upper reversal point has been reached, the percussive piston 3 begins to move in the direction of the work stroke (arrow 3*e*). The pilot-control valve 14 assumes the illustrated blocking position, and is held securely in this blocking position by the pressure exerted via the pilot-control pressure line 17 (because the work pressure is applied to the two adjusting surfaces V1 and V2).

When the percussive piston 3 impacts the chisel 4, the reversing line 9 is relieved from pressure via the circumferential groove 3*c* and the return line 10. Consequently, the slide valve 5*a* of the pilot valve 5 is switched into the illustrated return-stroke position due to the restoring force originating from the smaller control surface S1, thereby initiating the return stroke of the percussive piston. If the chisel 4 does not penetrate the material to be comminuted, the percussive piston 3 does not leave its defined, normal striking plane, so the opening 15*a* of the pilot-control line 15 remains blocked by the piston collar 3*b*. The percussive piston 3 continues its return stroke until the opening 9*a* of the reversing line 9 and the front cylindrical-space segment 2*b* connect the reversing line to the pressure line 8.

Accordingly, the work pressure is applied to the larger control surface S2, which transfers the slide valve 5*a* into the (left) work-stroke position, thereby connecting the rear cylindrical-space segment 2*a* to the pressure line 8 via the control line 11, and initiating a new work stroke.

If the position of the striking plane is shifted in the direction of the work stroke (arrow 3*e*) during the operation of the percussion device, the following procedures are followed:

After the pilot valve 5 has been switched into the work-stroke position, and the pilot-control valve 14 has been switched into the blocking position, the percussive piston 3 executes a work stroke. If the chisel 4 penetrates the material to be comminuted, the percussive piston 3 also leaves its normal striking plane and follows the chisel. This shift enables the opening of opening 15*a* of the pilot-control line 15, the opening 15*a* previously being blocked by the piston collar 3*b,* and effects the pressure relief of the connection to the return line 10 that is produced with the annular groove 3*c*. Correspondingly, the pilot-control valve 14 switches from its blocking position into the opening position, effecting a connection between the short-stroke line 18 and the additional line 19, which is in turn relieved of pressure via the reversing line 9 and the annular groove 3*c* with the return line 10. This pressure relief also switches the pilot valve 5 into the return-stroke position, after which the percussive piston 3 executes its return-stroke movement.

After a smaller stroke, the so-called short stroke, has been executed, the opening 18*a* of the short-stroke line 18 is enabled and connected to the pressure line 8 via the front cylindrical-space segment 2*b*. With the interposition of the pilot-control valve 14, the lines 15*b* and 15 as well as the lines 19 and 9 are relieved of pressure via the short-stroke line 18, which is acted upon by the work pressure. Consequently, the pilot valve 5 is switched into the (left) work-stroke position before the maximum possible stroke has been attained, thereby initiating a new work stroke.

At the same time, the pilot-control valve 14 is displaced into the illustrated blocking position, counter to the restoring force originating from the smaller adjusting surface V1, via the larger adjusting surface V2 of the pilot-control valve 14, the surface being subjected to the work pressure.

Thus, with each individual stroke of the percussive piston 3, the described embodiment permits a reaction to the properties or the behavior of the material to be comminuted. If the tool penetrates the material to be comminuted, the percussive piston only executes a short stroke, so the individual-strike energy is low. If the tool does not penetrate the material to be comminuted, a large stroke is executed with a corresponding maximum individual-strike energy.

Because operating conditions dictate that, despite the described automatic stroke reversal, no-load strikes of the percussive piston 3, and thus an unfavorable stressing of the percussion device, cannot be avoided, the percussion device is also equipped with a no-load safeguard that can be shut off. For this purpose, the interior of the work cylinder 2 additionally has a no-load-strike opening 20*a*. With an interposed no-load-strike line 20, a reversible safety element 21 is disposed upstream of this opening 20*a*. The input side of the safety element is connected to the pressure line 8 via an intermediate line 22, and is therefore continuously acted upon by the work pressure.

The safety element 21 can be switched between two end positions, namely, the (right) inoperative position and the (left) operative position. Whereas, in the illustrated operative position, the work pressure originating from the safety element 21 acts upon the no-load-strike opening 20*a,* the connection between the pressure line 8 and the no-load-strike opening 20*a* is broken in the inoperative position of the safety element 21.

As can further be seen from FIG. 1, the no-load-strike opening 20*a* is separate from the opening 18*a* of the short-stroke line 18. Accordingly, the no-load-strike safeguard with its essential components 20*a* and 21 can become effective regardless of the conditions in long- and short-stroke operation, should the percussive piston 3 overshoot the associated extended position by a predetermined distance to assume a no-load-strike position.

As explained above, in the drawing the percussive piston 3 assumes the normal striking position, in which the no-load-strike opening 20*a* is closed toward the interior of the work cylinder 2 by the front piston collar 3*b* having the smaller piston surface A1. If the percussive piston has extended so far in the work-stroke direction (arrow 3*e*) that the no-load-strike opening 20*a* is no longer closed by the front piston collar 3*b,* the work pressure applied to the opening can act on the larger valve surface S2 of the slide valve 5*a* with the interposition of the annular groove 3*c* and the control line 9, so the control 5 is held securely in the (left) work-stroke position present during the work stroke. To ensure that a sufficiently high pressure is present in the control line 9 during this time—despite a connection between the annular grove 3*c* and the return line 10—the return line 10 has a correspondingly-dimensioned outflow resistance, which is indicated by a throttle unit 10*b*. In other words, under the above-described conditions, the effect of the work pressure originating from the no-load-strike opening 20*a* prevents the control 5 from switching from the work-stroke position into the (right) return-stroke position, thereby shutting down the percussive piston 3. The percussion device cannot resume operation until the percussive piston 3 is mechanically lifted inside the work cylinder 2, namely in that the front piston collar 3*b* closes the no-load-strike opening 20*a* toward the interior of the work cylinder 2. Due to the associated change in the pressure level in the control line 9, the control 5 can switch from the work-stroke position into the return-stroke position, thereby initiating the return-stroke movement of the percussive piston 3.

The no-load-strike safeguard can be shut off simply in that the safety element 21 is switched into its (right) inoperative position. In this position, the no-load-strike opening 20*a* is ineffective, so the percussion device can only function in long- or short-stroke operation.

Figure 2:
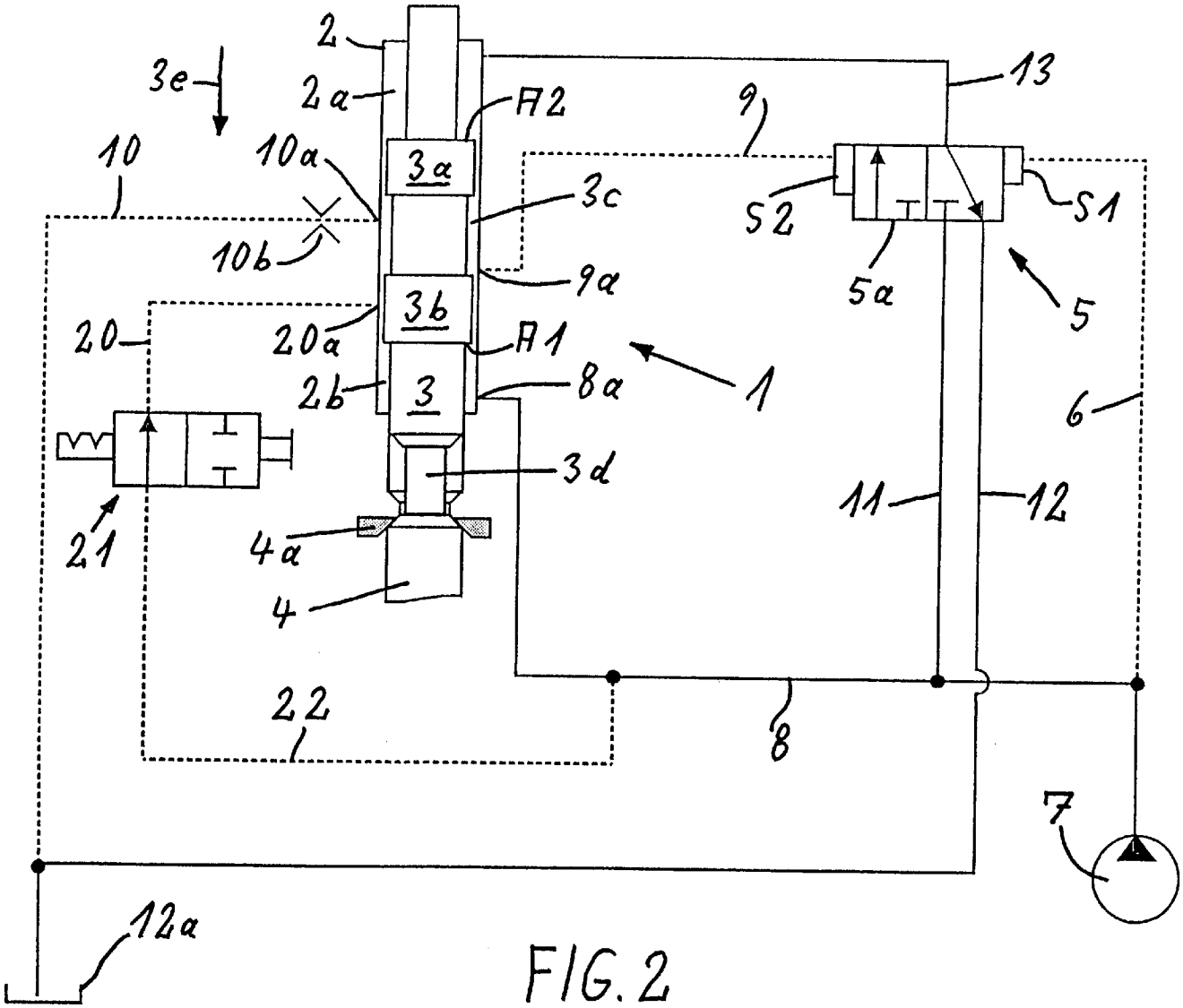
FIG. 2 is a schematic flow diagram of a percussion device embodied in accordance with the invention, without a pilot control (as in FIG. 1) that cooperates with the control.
Figure 3:
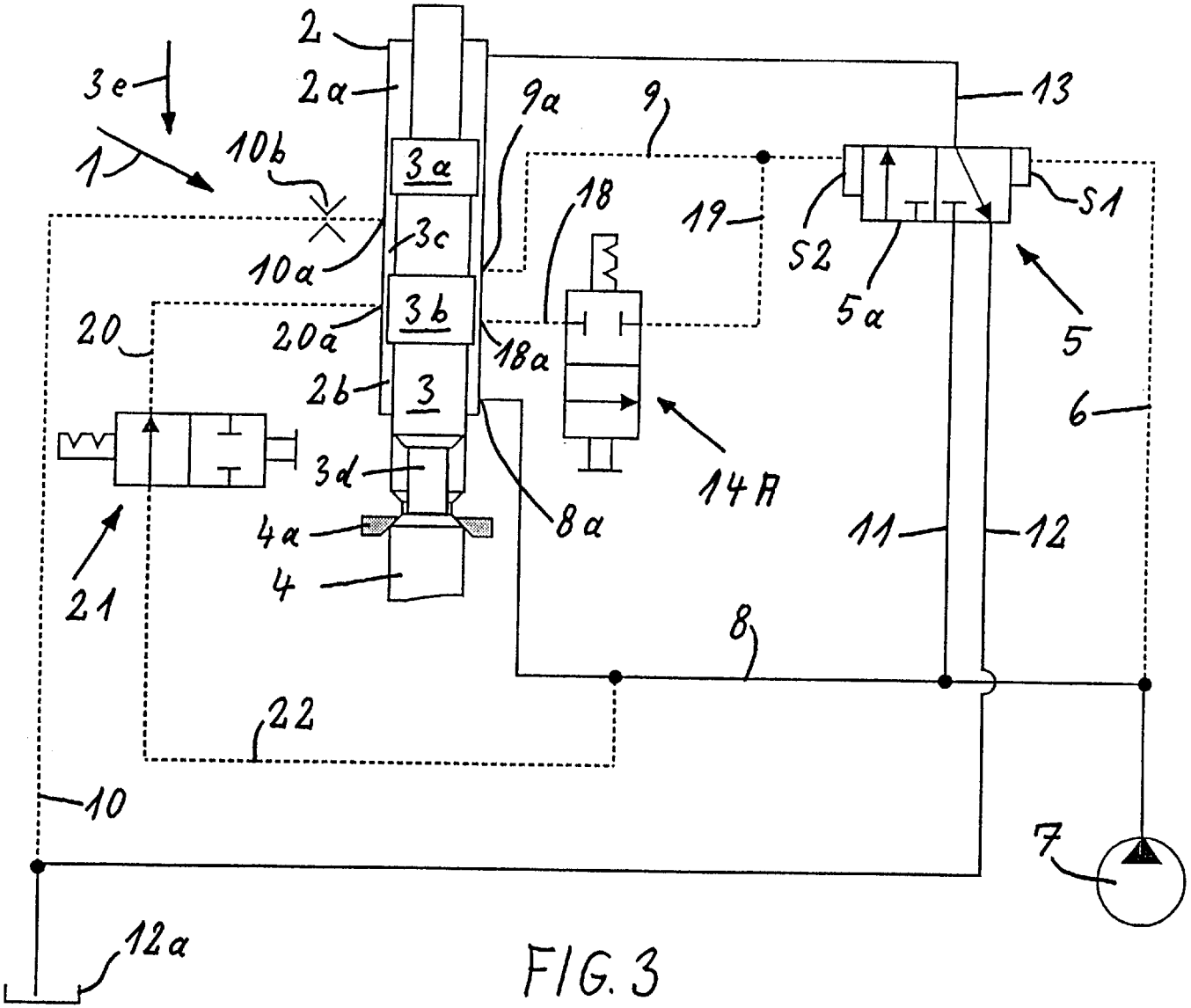
FIG. 3 is a schematic flow diagram of a percussion device embodied in accordance with the invention, with a reversing valve that is actuated purposefully for influencing the stroke of the percussive piston.

Unlike in the above-described embodiment according to FIG. 1, the no-load-strike safeguard (safety element 21) can also be used in connection with percussion devices possessing different embodiments, for example, in connection with the percussion device embodiments according to FIG. 2 or 3.

The embodiment according to FIG. 2 differs from that of FIG. 1 through the absence of an automatic pilot control in the form of a pilot-control valve 14.

Accordingly, in the discussed embodiment, the lines 15, 15*b,* 17, 17*a,* 18 and 19, as well as the openings 15*a,* 18*a* and the screen 16 associated with the line 15*b,* are absent.

Also in this case, the slide valve 5*a* of the pilot valve 5 either assumes the illustrated return-stroke position (on the right) or the work-stroke position (on the left), depending on the pressure conditions in the reversing line 9.

If the safety element 21 is located in the illustrated (left) operative position, after the piston collar 3*b* passes the control line 9, the line 9 is acted on by the work pressure via the no-load-strike line 20 in the direction of the work stroke (arrow 3*e*), so the control valve 5 is held securely in the work-stroke position assumed during the work stroke (as explained above in connection with FIG. 1). An appropriately-dimensioned outflow resistance (throttle unit 10*b*) in the return line 10 assures the buildup of a sufficiently high pressure in the control line 9.

In the embodiment according to FIG. 3, the control valve 5 is allocated a reversing valve 14A, which can be moved purposefully (preferably remotely actuated) between two end positions, namely the illustrated blocking position and an opening position.

The reversing valve 14A is connected via a short stroke line 18 with the opening 18*a* to the interior of the work cylinder 2, and via an additional line 19 to the reversing line 9.

In the illustrated blocking position, the reversing valve 14A exerts no influence on the position of the slide valve 5*a* of the control 5.

In contrast, if the reversing valve 14A assumes the (lower) opening position, a connection can be produced between the interior of the cylinder and the reversing line 9, depending on the position of the percussive piston 3 inside the work cylinder 2, with the connection effecting an adjustment of the slide valve 5*a* into the (left) work-stroke position. As soon as the piston collar 3*b* enables the opening 18*a* of the short-stroke line 18 during the return-stroke movement of the percussive piston 3, the line 18 is acted upon by the work pressure via the front cylindrical-space portion 2*b,* so that the slide valve 5*a* is displaced to the right due to the effect of the larger valve surface S2, which is now acted upon by pressure. This action prematurely initiates a new movement of the percussive piston 3 in the direction of the work stroke (arrow 3*e*).

The reversing valve 14A thus allows the function of the percussion device 1 to be influenced purposefully such that it may be temporarily operated in short-stroke operation.

Also in this embodiment, the no-load-strike safeguard (safety element 21) functions independently of the position of the reversing valve 14A. The safety element 21 assuming the (illustrated) operative position causes the reversing line 9 to be acted upon with a sufficiently high pressure only after the piston collar 3*b* of the percussive piston 3 that has been moved in the work-stroke direction has enabled the opening 20*a* of the no-load-strike line 20. Because of the pressure conditions that then dominate, the slide valve 5*a* cannot be switched into the (illustrated) return-stroke position, so the percussion device 1 is shut down.

Provided that the no-load-strike safeguard meets its remaining requirements, it can have an arbitrary embodiment and location.

As can be seen from the exemplary embodiments according to FIGS. 4 through 8*a, b,* which will be described below, the no-load-strike safeguard is embodied such that the breakable connection between the safety element 21 and the no-load-strike opening 20*a* is inside the work cylinder 2, and the safety element 21, which is accessible from the outside 2*c* of the work cylinder, constitutes a detachable component that is essentially disposed inside the work cylinder.

In contrast, it is also possible within the spirit of the invention to arrange the breakable connection and the safety element 21 in their own housing outside of the work cylinder.

Figure 4:
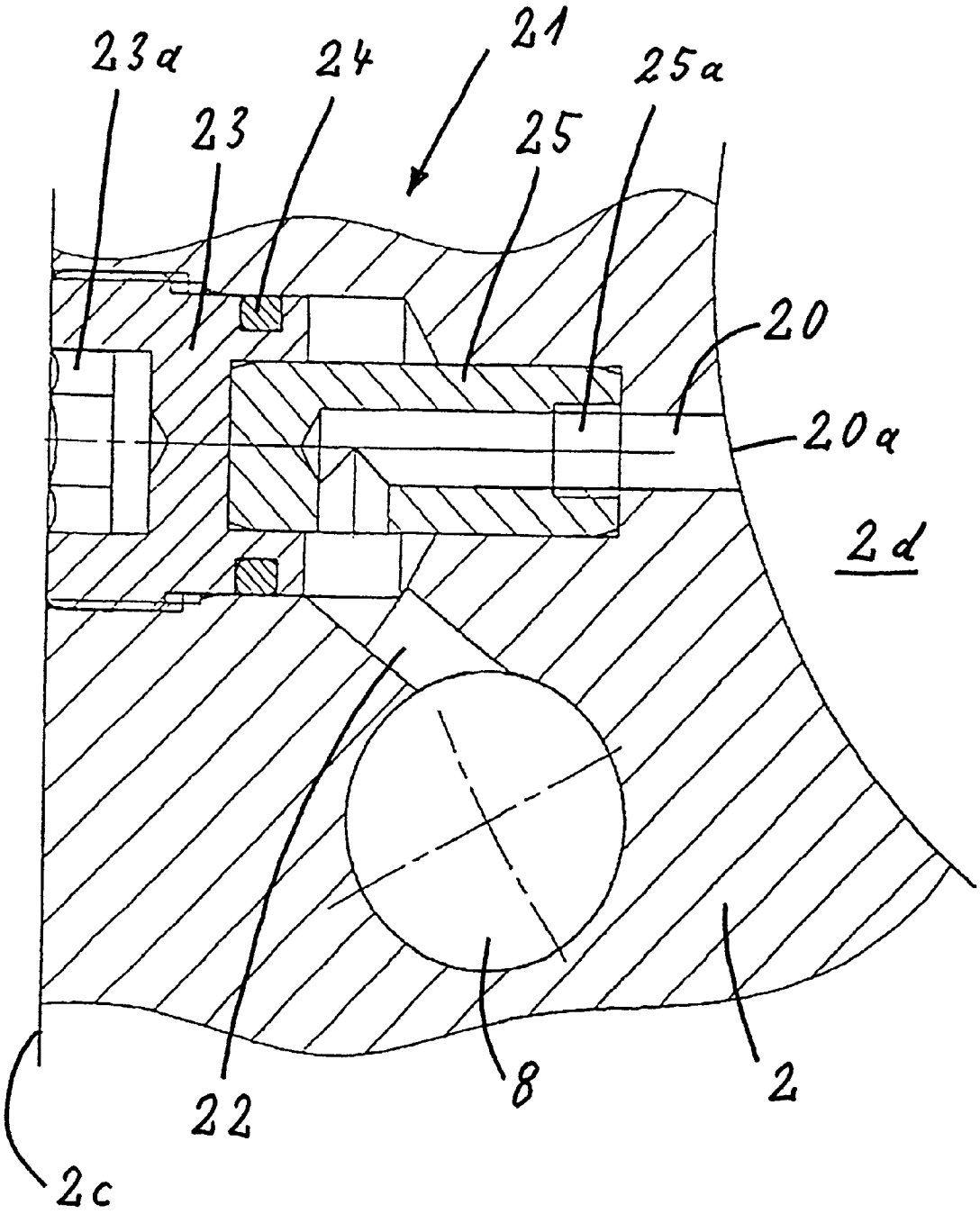
FIG. 4 shows, in a partial section, a safety element that is disposed in the work cylinder, and has a pin that can be inserted at different locations to serve either as a bridging element or a blocking element.

In accordance with FIG. 4, the safety element 21 has a threaded pin 23, which is screwed to the work cylinder 2, is accessible from the outside 2*c* of the cylinder, and is provided there with a hexagon socket 23*a*. On the side facing the interior 2*d* of the work cylinder 2, a sealing element 24 shields the threaded pin 23 against the environment.

In the region between the no-load-strike opening 20*a* with the no-load-strike line 20 and the intermediate line 22, an adjusting pin 25, in which a connecting bore 25*a* extends, is supported inside the work cylinder 2 and against the threaded pin 23. In the illustrated operative position of the safety element 21, the adjusting pin 25 connects the lines 20 and 22 to one another.

Under the effect of the threaded pin 23, the adjusting pin 25 is clamped in the work cylinder 2, in the direction of the no-load-strike line 20.

After removal of the threaded pin 23, the adjusting pin 25 can be rotated, outside of the work cylinder 2, by 180° relative to its transverse axis, and re-inserted into the work cylinder in this position. Consequently, the no-load-strike line 20 is closed in the direction of the threaded pin 23, which is then screwed in, and the safety element 21 thus assumes the inoperative position.

The discussed embodiment therefore permits the no-load-strike safeguard to be transferred into the desired end position with little intervention, which simultaneously ensures that the predetermined end position is retained, unchanged, regardless of the operating conditions.

Figure 5:
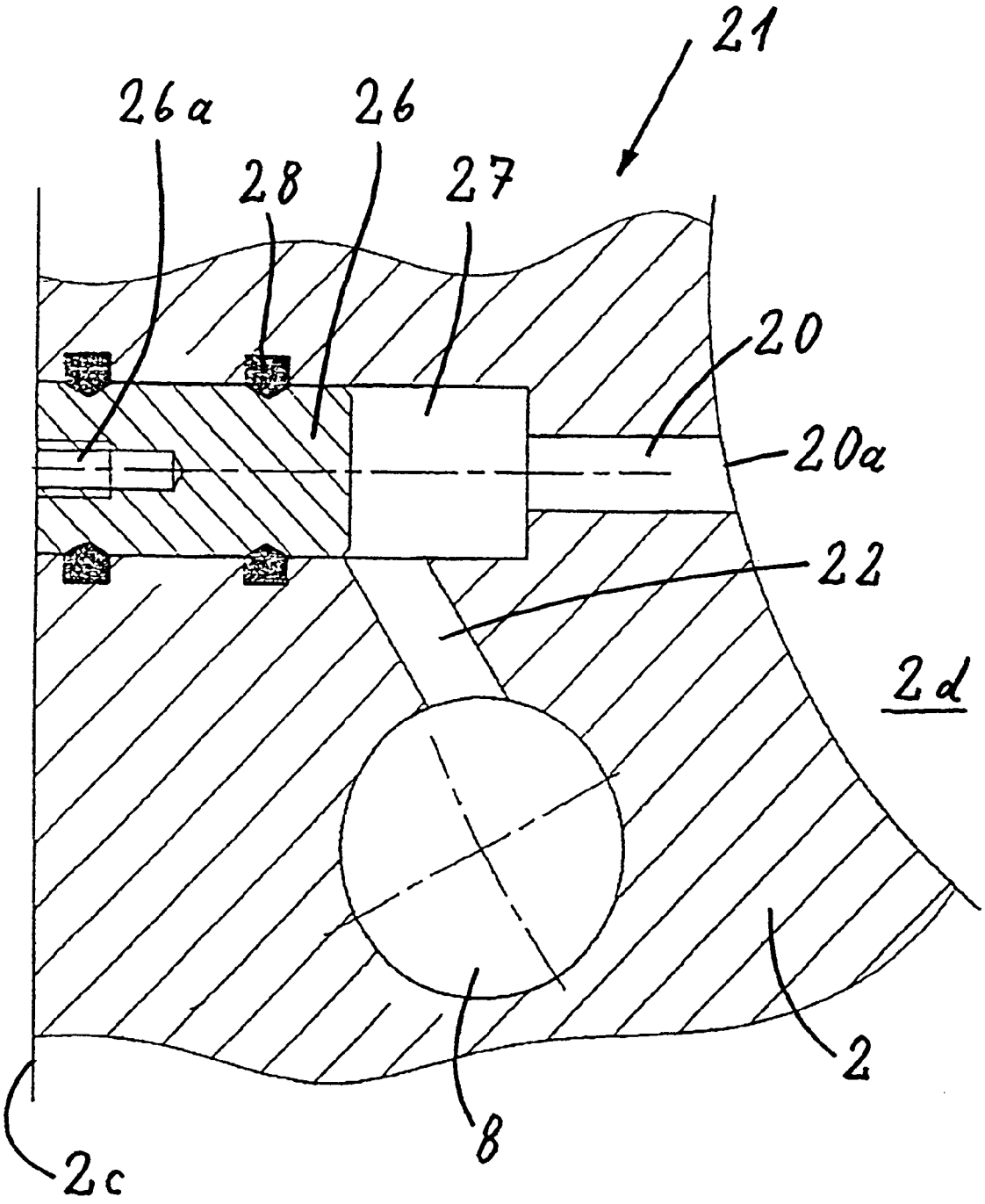
FIG. 5 shows, in a partial section, a safety element that is disposed in the work cylinder, and has a latching pin that can be secured in numerous positions inside the work cylinder.

In the embodiment according to FIG. 5, the safety element 21 has a latching pin 26, which is held in a bore 27 and is provided with a threaded bore 26*a* that faces the outside 2*c*. The bore 27 is connected to the lines 20 and 22.

To assure a fixed position, the latching pin 26 is supported on the work cylinder 2 via two split washers 28, and can be displaced out of the illustrated position (corresponding to the operative position of the safety element 21) in the direction of the no-load-strike opening 20*a,* counter to the effect of the split washers 28, until the connection between the lines 20 and 22 (corresponding to the inoperative position of the safety element 21) is broken.

The threaded bore 26*a* serves to displace the latching pin 26 in the desired manner, by means of a screwed-in tool, or to insert or remove the pin.

The discussed embodiment can also be modified within the spirit of the invention such that, for transferring the safety element into its inoperative position, the illustrated latching pin 26 is removed and replaced by a longer latching pin, which, when inserted, closes the intermediate line 22 against the no-load-strike line 20, thereby breaking the connection between the no-load-strike opening 20*a* and the pressure line 8.

Figure 6:
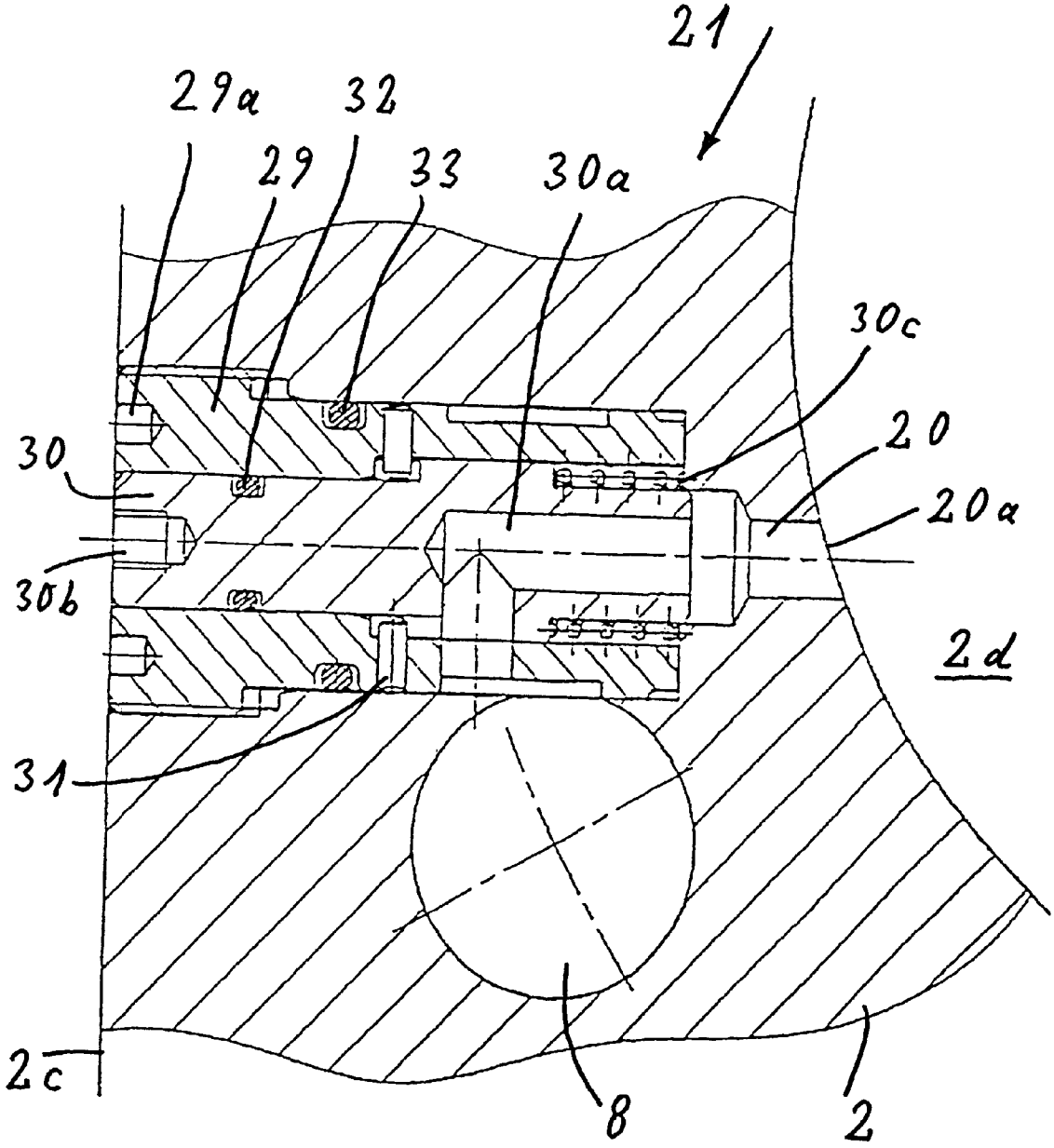
FIG. 6 shows, in a partial section, a safety element having a hollow cylinder that can be screwed into the work cylinder, and an adjusting pin that is rotatably held in this cylinder.

In the embodiment according to FIG. 6, the safety element 21, which is illustrated in the operative position, has a hollow cylinder 29 that is screwed into the work cylinder 2 from the outside 2*c,* and an adjusting pin 30 that is held to rotate inside the hollow cylinder and has a connecting conduit 30*a*. The conduit 30*a* can either produce or break the connection between the no-load-strike opening 20*a* and the pressure conduit 8 (as shown), depending on the rotational position of the adjusting pin 30 with respect to the hollow cylinder 29.

To support the adjusting pin 30 in the axial direction, the hollow cylinder 29 has a plurality of carrier pins 31 that, when seen from the outside 2*c,* project in front of the connecting conduit 30*a,* in the direction of the adjusting pin 30, and carry the pin in the direction of the no-load-strike opening 20*a* (i.e., in the axial direction) when the hollow cylinder 29 is screwed in.

The adjusting pin 30 is further supported on the work cylinder 2 by a prestressed spring element 30*c* in the region of the connecting conduit 30*a*.

The effect of the spring element 30*c* keeps the adjusting pin 30 in contact with the carrier pins 31, thereby safeguarding it against an undesired change in its rotational position relative to the hollow cylinder 29.

A sealing element 32 seals the adjusting pin 30 against the hollow cylinder 29, which in turn receives a sealing element 33 for sealing against the work cylinder 2.

The provision of the parts 29 and 30 with a plurality of counterbores 29*a,* or a threaded bore 30*b,* in the region of the outside 2*c* facilitates their handling.

The rotational position of the adjusting pin 30 can be changed through a displacement in the direction of the no-load-strike opening 20*a* (to the right), counter to the restoring effect of the spring element 30*c*. In this state, the adjusting pin 30 can be transferred into the desired rotational position relative to the hollow cylinder 29, in which position it remains fixed after the cessation of the axial force acting on it.

Accordingly, it is possible to bring the safety element 21 into its inoperative position through a sufficiently large rotational movement of the adjusting pin 30, for example by 90°. The advantage of the discussed embodiment is that the adjusting pin 30 is rotated in the desired manner, without the removal of the safety element and under the effect of an axial force that acts on the pin, and the adjusting pin 30 can be fixed in the desired rotational position after the cessation of the axial force, in which position it is supported on the carrier pins 31 under the effect of the spring element 30*c* in the axial direction.

Figure 7:
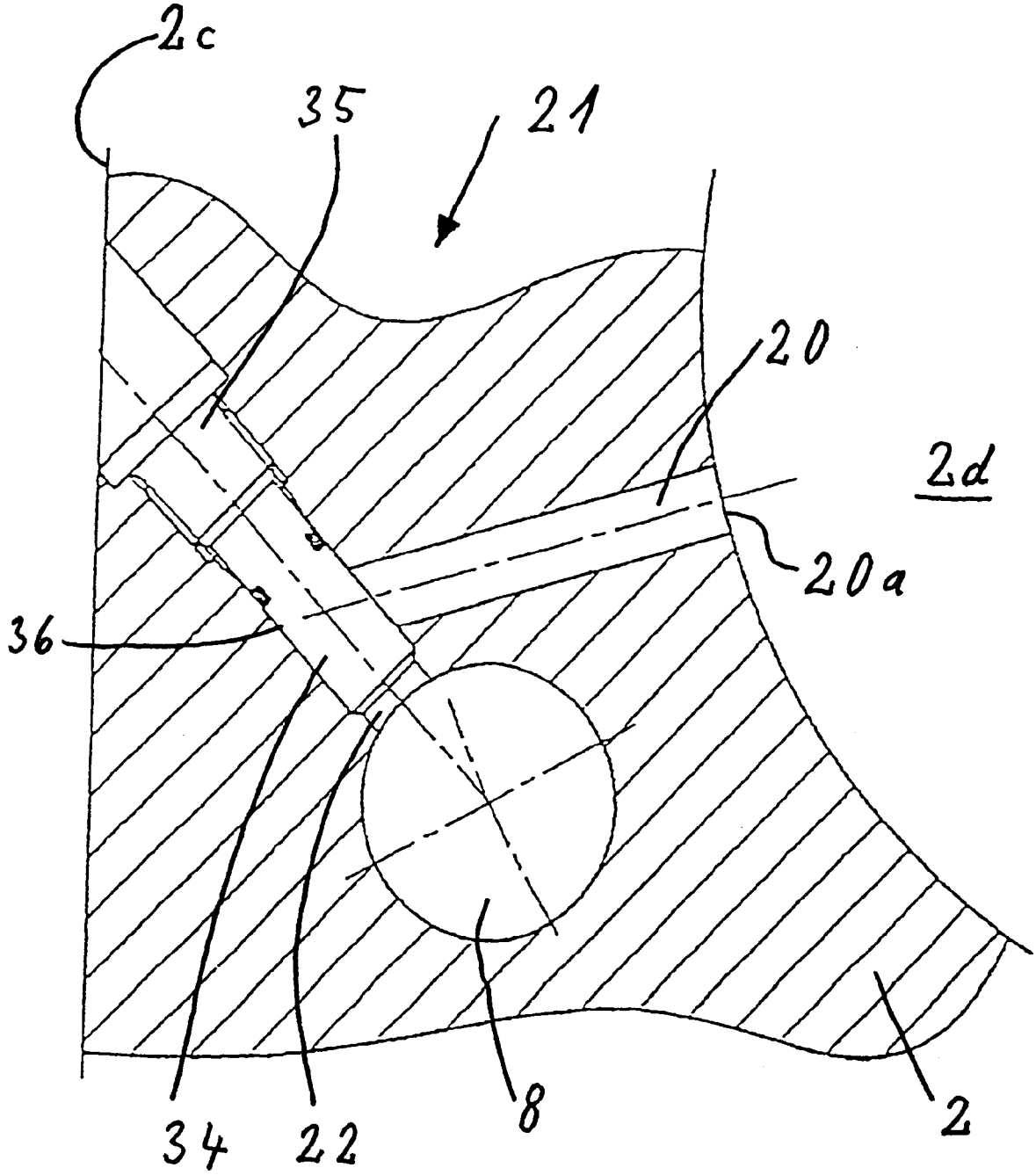
FIG. 7 shows, in a partial section, a safety element that is disposed in the work cylinder, and whose function can be altered by means of an exchangeable pin that can be secured in a receiving bore.

FIG. 7 shows an especially simple embodiment of the safety element 21, in which its components are disposed at an incline relative to the outside 2*c* of the work cylinder 2.

In the illustrated inoperative position, the safety element 21 has an exchangeable pin 34, which serves as a blocking element and is held in a bore 36, which connects the lines 20 and 22, due to the effect of a threaded pin 35.

The safety element 21 can be transferred easily into the operative position in that the exchangeable pin 34 is removed after the threaded pin 35 is detached, and the bore 36 is then only closed by the threaded pin 35 in the direction of the outside 2*c*.

Figure 8A:
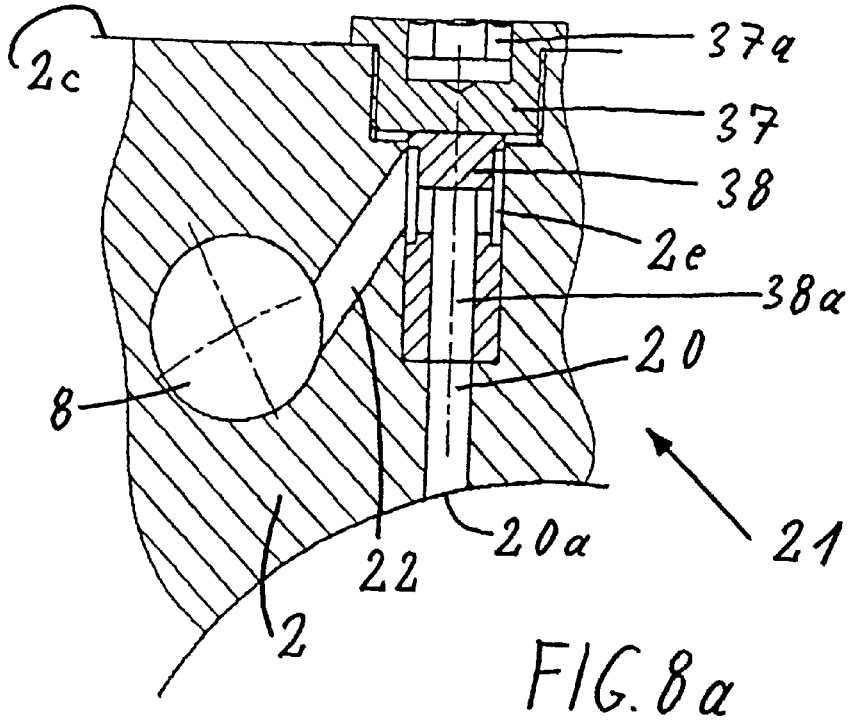
FIGS. 8*a* and 8*b* show, in a partial section, a safety element that is disposed in the work cylinder and has an exchangeable pin, which is embodied as a bridging or blocking element.
Figure 8B:
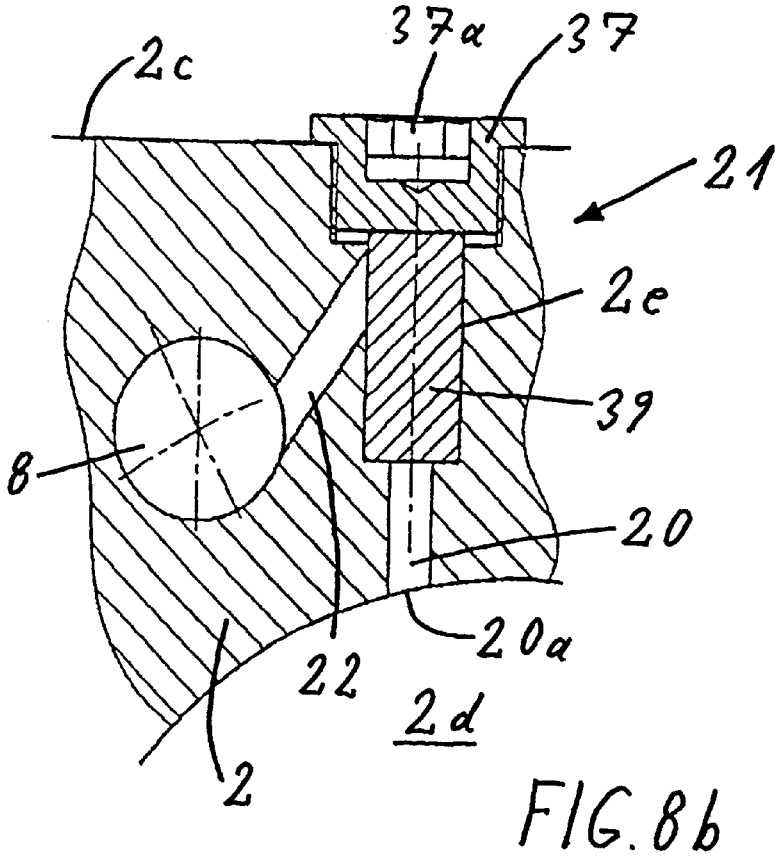

In the embodiment according to FIGS. 8*a* and 8*b,* a threaded pin 37, which is screwed into the work cylinder 2, holds an exchangeable pin 38 in contact inside a receiving bore 2*e,* in the direction of the no-load-strike opening 20*a*. The exchangeable pin 38 is provided with a connecting bore 38*a* such that it connects the lines 20 and 22 to one another, and thus permits the no-load-strike opening 20*a* to be acted upon by pressure via the pressure line 8.

The threaded pin 37 can be detached, that is, screwed out away from the no-load-strike opening 20*a,* or screwed in toward the no-load-strike opening 20*a,* by use of a hexagonal socket 37*a* extending from the outside 2*c*.

Starting from the operative position illustrated in FIG. 8*a,* the safety element 21 can be transferred into its inoperative position (FIG. 8*b*) through the replacement of the exchangeable pin 38 with an exchangeable pin 39 embodied as a solid pin. This pin completely fills the receiving bore 2*e,* thus eliminating the connecting bore 38*a,* so the lines 20 and 22 are no longer connected.

Borrowing from the embodiment according to FIG. 6, the latter embodiment can also be modified within the spirit of the invention such that, instead of the exchangeable pins 38 and 39, the safety element 21 has an adjusting pin that is similar to the adjusting pin 30. This pin is embodied such that it either produces or breaks a connection between the lines 20 and 22 through a rotation of 180° relative to its longitudinal axis.

The particular advantage attained with the invention is that it permits the shutdown of the percussive piston, regardless of whether long- or short-stroke operation is in effect, as soon as the piston has overshot an extended position occurring in normal operation by a predetermined distance in the work-stroke direction, and assumes a no-load-strike position that is defined by the position of the opening 20*a* of the no-load-strike line 20.

If the safety element of the no-load-strike safeguard assumes its operative position, the percussive piston is automatically blocked as it approaches the predetermined no-load-strike position. The percussion device can only be set in operation again through the mechanical lifting of the percussive piston. If the safety element assumes its inoperative position, the no-load-strike opening 20*a* becomes inoperative. Accordingly, the percussion device is not shut down if the percussive piston overshoots its extended position occurring in normal operation in the work-stroke direction.

The invention now being fully described, it will be apparent to one of the ordinary skill in the art that many changes and modifications can be made thereto without departing from the spirit or scope of the invention as set forth herein.

We claim:

1. A fluid-operated percussion device comprising:

a percussive piston that moves in a work cylinder and strikes a tool, said percussive piston having two opposed piston end surfaces of different sizes, with a smaller of the piston end surfaces, which is effective in the direction of a return stroke, being continuously connected to a pressure line that is acted upon by a work pressure, and a larger of the two piston end surfaces, which is effective in the direction of a work stroke, being alternately connected via a pilot valve to the pressure line and to a pressure-less return line;

a control having a slide valve that moves in a pilot valve, said slide valve having two valve surfaces that are of different sizes and are effective in opposite directions of movement, with a smaller of the valve surfaces of the slide valve, which smaller valve surface acts on the slide valve in the direction of the return-stroke position of the slide valve, being continuously connected to the pressure line, and a larger of the valve surfaces of the slide valve being alternately connected temporarily to said pressure line and to said return line via a circumferential groove disposed on the piston surface between the piston end surfaces;

the interior of the work cylinder additionally has a no-load-strike opening, which opening is enabled, in the direction of the interior, by a front piston collar of the percussive piston, with the front piston collar having the smaller piston surface, after the percussive piston has overshot an extended position occurring in normal operation, by a predetermined distance in the work-stroke direction to assume a no-load-strike position;

a safety element, which can be switched between a first inoperative end position and a second operative end position and whose input side is connected to the pressure line, is disposed upstream of the no-load-strike opening, with the safety element acting on the no-load-strike opening with the work pressure originating from the safety element in the second operative end position, and with the safety element breaking the connection between the pressure line and the no-load-strike opening in the first inoperative end position; and when the safety element assumes the second operative end position and the percussive piston reaches the no-load-strike position, the work pressure applied to the no-load-strike opening acts on the control via the circumferential groove such that the slide valve of the control is blocked in the work-stroke position.

2. The percussion device according to claim 1, wherein the breakable connection between the safety element and the no-load-strike opening is located inside a housing that represents at least one component of the work cylinder.

3. The percussion device according to claim 1 wherein the safety element forms a detachable component that is accessible from the outside of the percussion device and is disposed inside one of a housing and the work cylinder.

4. The percussion device according to claim 1, wherein the safety element is a rotary slide valve.

5. The percussion device according to claim 4, wherein the rotary slide valve has a screw-in hollow cylinder and an adjusting pin, which is rotatably held inside the cylinder and has a connecting conduit, via which depending on the rotational position of the adjusting pin, a connection is produced between the no-load-strike opening and the pressure line, with the rotational position of the adjusting pin being fixed via clamping with the hollow cylinder.

6. The percussion device according to claim 1, wherein the safety element has a latching pin, which is securable in a plurality of positions inside a receiving component constituted by one of a housing and the work cylinder, with a connection being present between the pressure line and the no-load-strike opening in a first latched position, or being broken in a second latched position.

7. The percussion device according to claim 6, wherein the latching pin is displaceable longitudinally between the first and second latched positions, counter to the effect of at least one split washer serving as a counterbearing for the pin.

8. The percussion device according to claim 1 wherein the safety element has a threaded pin, which is accessible from the outside of a receiving component for the pin constituting one of a housing and the work cylinder and is screwed to the receiving component, as well as an exchangeable pin, which is securable inside a receiving bore, with the exchangeable pin being one of a bridging element that connects the no-load-strike opening to the pressure line, and a blocking element that blocks the connection between the pressure line and the no-load-strike opening.

* * * * *